US011414933B2

(12) United States Patent
Amri et al.

(10) Patent No.: US 11,414,933 B2
(45) **Date of Patent: *Aug. 16, 2022**

(54) DRILLING BOTTOM HOLE METHODS FOR LOSS CIRCULATION MITIGATION

(71) Applicant: Saudi Arabian Oil Company, Dhahran (SA)

(72) Inventors: Khalifah M. Amri, Dhahran (SA); Abdulrahman Anwar Al Essa, Dhahran (SA); Shaohua Zhou, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 0 days.

This patent is subject to a terminal disclaimer.

(21) Appl. No.: 17/129,749

(22) Filed: Dec. 21, 2020

(65) Prior Publication Data

US 2021/0108466 A1 Apr. 15, 2021

Related U.S. Application Data

(62) Division of application No. 15/399,649, filed on Jan. 5, 2017, now Pat. No. 10,900,289.

(51) Int. Cl.
*E21B 10/32* (2006.01)
*E21B 7/28* (2006.01)
(Continued)

(52) U.S. Cl.
CPC ..... *E21B 10/32* (2013.01); *E21B 7/28* (2013.01); *E21B 21/003* (2013.01); *E21B 43/103* (2013.01)

(58) Field of Classification Search
CPC ..... E21B 43/103; E21B 21/00; E21B 21/003; E21B 7/28
See application file for complete search history.

(56) References Cited

U.S. PATENT DOCUMENTS 2,681,112 A 6/1954 Lee et al.
3,477,506 A 11/1969 Malone
(Continued)

FOREIGN PATENT DOCUMENTS

WO WO 03042486 5/2003
WO WO-03042486 A2 * 5/2003 ..... E21B 33/126
WO WO 2006009763 1/2006

OTHER PUBLICATIONS

GCC Examination Report in GCC Appln. No. GC 2018-34575, dated Mar. 1, 2021, 5 pages.
(Continued)

*Primary Examiner* — Blake Michener
*Assistant Examiner* — Theodore N Yao
(74) *Attorney, Agent, or Firm* — Fish & Richardson P.C.

(57) ABSTRACT

A drilling bottom hole assembly for loss circulation mitigation includes a drill bit configured to drill a wellbore in a formation. The drill bit is attached to a drill string. The wellbore includes a high-loss circulation zone into which drilling fluid is lost during drilling the wellbore. An under reamer is attached to the drill string upstring of the drill bit. The under reamer is downhole of the high-loss circulation zone. The under reamer, in response to actuation, is configured to widen a diameter of the high-loss circulation zone. An expansion assembly is connected to the under reamer. The expansion assembly surrounds the drill string upstring of the under reamer. The expansion assembly is configured to cover the high-loss circulation zone after the diameter of the high-loss circulation zone is widened by the under reamer.

10 Claims, 5 Drawing Sheets

(51) Int. Cl.
*E21B 43/10* (2006.01)
*E21B 21/00* (2006.01)

(56) References Cited

U.S. PATENT DOCUMENTS

| | | | | |
|---|---|---|---|---|
| 6,059,033 | A | 5/2000 | Ross et al. | |
| 6,799,637 | B2 | 10/2004 | Schetky et al. | |
| 6,986,390 | B2 | 1/2006 | Doane et al. | |
| 7,051,805 | B2 | 5/2006 | Doane et al. | |
| 7,543,639 | B2 | 6/2009 | Emerson et al. | |
| 9,476,288 | B2 | 10/2016 | Hazelip | |
| 2003/0141079 | A1 | 7/2003 | Doane et al. | |
| 2003/0173076 | A1 | 9/2003 | Sheiretov | |
| 2004/0040723 | A1 | 3/2004 | Hovem | |
| 2005/0005668 | A1* | 1/2005 | Duggan | C21D 7/04 72/370.06 |
| 2005/0023002 | A1 | 2/2005 | Zamora et al. | |
| 2005/0034876 | A1 | 2/2005 | Doane et al. | |
| 2005/0194129 | A1 | 9/2005 | Campo | |
| 2006/0016597 | A1* | 1/2006 | Emerson | E21B 7/20 166/277 |
| 2006/0185857 | A1 | 8/2006 | York et al. | |
| 2010/0270035 | A1 | 10/2010 | Ring et al. | |
| 2013/0068481 | A1* | 3/2013 | Zhou | E21B 43/105 166/381 |
| 2016/0362958 | A1* | 12/2016 | Zhou | E21B 17/10 |

OTHER PUBLICATIONS

GCC Examination Report in GCC Appln. No. GC 2018-34575, dated Sep. 6, 2020, 4 pages.

International Search Report and Written Opinion issued in International Application No. PCT/US2018/012195 on Apr. 9, 2018, 13 pages.

* cited by examiner

DRILLING BOTTOM HOLE METHODS FOR LOSS CIRCULATION MITIGATION

CROSS-REFERENCE TO RELATED APPLICATIONS

This application is a divisional of and claims the benefit of U.S. application Ser. No. 15/399,649 filed on Jan. 5, 2017, the entire contents of which are incorporated by reference in its entirety.

TECHNICAL FIELD

This specification relates to wellbore drilling.

BACKGROUND

In wellbore drilling, a drill bit is attached to a drill string, lowered into a wellbore, and rotated in contact with a formation. The rotation of the drill bit breaks and grinds the formation into small pieces called "cuttings" as the drill bit penetrates the rock forming a wellbore. A drilling fluid, also known as drilling mud, is circulated down the drilling string from the topside equipment and through the drill string, drill bit, and into the wellbore. The fluid then flows upward back toward the topside through an annulus formed between the drill string and the wall of the wellbore. The drilling fluid serves many purposes including cooling the drill bit, supplying hydrostatic pressure upon the formation penetrated by the wellbore to prevent fluids from flowing into the wellbore and causing a blow-out, and carrying the formation cuttings. Sometimes, the drilling fluid can be absorbed by or flow into the formation resulting in loss circulation.

SUMMARY

This specification describes technologies relating to a drilling bottom hole assembly for loss circulation mitigation.

Certain aspects of the subject matter described here can be implemented as a bottom hole assembly. A drill bit is configured to drill a wellbore in a formation. The drill bit is attached to a drill string. The wellbore includes a high-loss circulation zone into which drilling fluid is lost during drilling the wellbore. An under reamer is attached to the drill string upstring of the drill bit. The under reamer is downhole of the high-loss circulation zone. The under reamer, in response to actuation, is configured to widen a diameter of the high-loss circulation zone. An expansion assembly is connected to the under reamer. The expansion assembly surrounds the drill string upstring of the under reamer. The expansion assembly is configured to cover the high-loss circulation zone after the diameter of the high-loss circulation zone is widened by the under reamer.

This, and other aspects, can include one or more of the following features. The expansion assembly can include a radially expandable clad that can expand from a first diameter to a second diameter greater than the first diameter. The second diameter can be substantially equal to the diameter of the high-loss circulation zone widened by the under reamer. The clad can surround the drill string. The expansion assembly, in response to actuation, can radially expand the clad from the first diameter to the second diameter. Prior to the actuation of the expansion assembly, the clad is attached to the drill string. After the actuation of the expansion assembly, the clad can be detached from the drill string and can be attached to the high-loss circulation zone. The clad can include an expandable base pipe surrounding the drill string, and a hanger surrounding the drill string. The hanger can be connected to the expandable base pipe. The hanger can anchor the clad to the high-loss circulation zone when the clad is radially expanded to the second diameter. The hanger can be a first hanger connected to a downstring end of the expandable base pipe. The clad can include a second hanger connected to an upstring end of the expandable base pipe. The second hanger can be configured to anchor the clad to the high-loss circulation zone when the clad is radially expanded to the second diameter. Either the expandable base pipe or the hanger can be attached to the drill string prior to the actuation of the expansion assembly. The expansion assembly can include a mandrel surrounding the drill string downstring of the clad. The mandrel can slide toward the clad. The expansion assembly can include a power spring attached to the mandrel. In response to the actuation of the expansion assembly, the power string can direct the mandrel toward the clad. The power string can be a compressed power spring which can be released in response to the actuation of the expansion assembly to push the mandrel toward the clad. The expansion assembly can include a sliding sleeve surrounded by the drill string that can slide within the drill string to actuate the expansion assembly. The power spring can direct the mandrel towards the clad in response to the sliding sleeve sliding within the drill string. The mandrel can be a first mandrel. The power spring can be a first power spring. The bottom hole assembly can include a second mandrel surrounding the drill string upstring of the clad. The second mandrel can slide toward the clad. The bottom hole assembly can also include a second power spring attached to the second mandrel. In response to the actuation of the expansion assembly, the second power spring can direct the second mandrel toward the clad. The sliding sleeve can be a first sliding sleeve. The expansion assembly can include a second sliding sleeve that can slide within the drill string to actuate the expansion assembly. In response to the second sliding sleeve sliding within the drill string, the second power spring can direct the second mandrel towards the clad.

Certain aspects of the subject matter described here can be implemented as a method. A wellbore is drilled in a formation using a bottom hole assembly that includes a drill bit attached to a drill string, an under reamer attached to the drill string upstring of the drill bit, and an expansion assembly surrounding the drill string upstring of the under reamer. While drilling the wellbore in the formation, a high-loss circulation zone into which the drilling fluid is lost during the drilling is encountered. The under reamer is positioned downhole of the high-loss circulation zone. The bottom hole assembly is moved in an uphole direction to expand a diameter of the high-loss circulation zone using the under reamer while retaining the bottom hole assembly within the wellbore. After expanding the diameter of the high-loss circulation zone, the bottom hole assembly is moved in a downhole direction to position the expansion assembly adjacent the high-loss circulation zone. After positioning the expansion assembly adjacent the high-loss circulation zone, the high-loss circulation zone is covered using the expansion assembly.

This, and other aspects, can include one or more of the following features. Drilling the wellbore can continue in the formation after covering the high-loss circulation zone using the expansion assembly. To expand the diameter of the high-loss circulation zone using the under reamer, the under reamer can be engaged, and, prior to continuing drilling in the wellbore, the under reamer can be disengaged. The high-loss circulation zone can be covered using the expansion assembly without removing the bottom hole assembly from within the wellbore. To move the bottom hole assembly in the uphole direction to expand the diameter of the high-loss circulation zone using the under reamer, a first diameter of a first portion of the wellbore above the high-loss circulation zone can be expanded and a second diameter of a second portion of the wellbore below the high-loss circulation zone can also be expanded. An uphole end of the high-loss circulation zone can be below a surface of the formation. The bottom hole assembly can be moved in the uphole direction to at least the uphole end of the high-loss circulation zone and below the surface of the formation.

Certain aspects of the subject matter described here can be implemented as a method. A wellbore is drilled in a formation using a bottom hole assembly that includes a drill bit attached to a drill string, an under reamer attached to the drill string upstring of the drill bit, and an expansion assembly surrounding the drill string upstring of the under reamer. After drilling the wellbore to a depth in the formation, a high-loss circulation zone into which drilling fluid is lost during the drilling is encountered. The wellbore drilling is continued until the under reamer is positioned downhole of the high-loss circulation zone. The bottom hole assembly is moved by a first distance in an uphole direction to expand a diameter of the high-loss circulation zone using the under reamer. The distance by which the bottom hole assembly is moved in the uphole direction is less than the depth to which the wellbore is drilled. After expanding the diameter of the high-loss circulation zone, the bottom hole assembly is moved in a downhole direction by a second distance to position the expansion assembly adjacent the high-loss circulation zone. After positioning the expansion assembly adjacent the high-loss circulation zone, the high-loss circulation zone is covered using the expansion assembly.

This, and other aspects, can include one or more of the following features. The wellbore drilling in the formation can be continued after covering the high-loss circulation zone using the expansion assembly. The expansion assembly can include a radially expandable clad that can expand from a first diameter to a second diameter greater than the first diameter. The second diameter can be substantially equal to the diameter of the high-loss circulation zone widened by the under reamer. The clad can surround the drill string. The clad can include an expandable base pipe surrounding the drill string, and a hanger surrounding the drill string. The hanger can be connected to the expandable base pipe. The hanger can be configured to anchor the clad to the high-loss circulation zone when the clad is radially expanded to the second diameter. To move the bottom hole assembly in the downhole direction by the second distance to position the expansion assembly adjacent the high-loss circulation zone, an upstring end of the expandable base pipe can be positioned substantially adjacent an uphole end of the high-loss circulation zone.

The details of one or more implementations of the subject matter described in this specification are set forth in the accompanying drawings and the description below. Other features, aspects, and advantages of the subject matter will become apparent from the description, the drawings, and the claims.

BRIEF DESCRIPTION OF THE DRAWINGS

Like reference numbers and designations in the various drawings indicate like elements.

DETAILED DESCRIPTION

A potential issue during drilling operations occurs when a high-loss circulation zone is encountered. A high-loss circulation zone is a section in the formation where both the pressure of the formation is significantly lower than the hydrostatic pressure of the drilling fluid and the permeability (ease of flow through the rock formation) is high enough to allow the drilling fluid to enter the formation rather than return to a surface topside facility through the annulus. The loss of fluid decreases the protection provided by the hydrostatic pressure of the drilling fluid column as sufficient fluid height no longer exists in the annulus. Additionally, drilling costs increase due to the amount of drilling fluid continuously consumed. Some techniques to mitigate high-loss circulation zone involve flowing particulates downhole to plug the high-loss zone. The likelihood of success in such techniques is sometimes low.

This specification describes a bottom hole assembly for loss circulation mitigation and methods for implementing the same. The system includes three components: a drill bit, an under reamer, and a radially expandable clad. The drill bit is attached to the downstring end of a drill string and can create a wellbore by pulverizing rock in a formation into small bits called cuttings. The under reamer is attached to the drill string upstring of the drill bit and is configured to enlarge the hole size across a high-loss circulation zone encountered in the wellbore prior to the installation of the radially expandable clad. In other words, the under reamer expands the surface area of the wellbore in the high-loss circulation zone. The radially expandable clad is used to mechanically isolate or seal off the high-loss circulation zone by installing a barrier wall to substantially mitigate further drilling mud losses in the zone. The example implementations described hereafter are described with reference to a vertical well, but the techniques described in the disclosure are applicable in a well having any orientation, for example, horizontal, or deviated hole section.

The bottom hole assembly can seal a high-loss circulation zone without the need to pull the drill string out of the wellbore. The ability to seal the high-loss circulation zone while remaining in the wellbore can significantly decrease drilling time and associated drilling costs. By implementing the bottom hole assembly described here, the uncontrolled loss of drilling fluids into the formation can be limited without the need to remove the drill string from the wellbore. The tools described here can be implemented to be simple and robust, thereby decreasing cost to manufacture the tools. The tool system can be utilized anytime a high-loss circulation zone is encountered during drilling operations. The tool system can be used for the entire section of the wellbore normally without activating the clad deployment if the clad is not needed.

Figure 1:
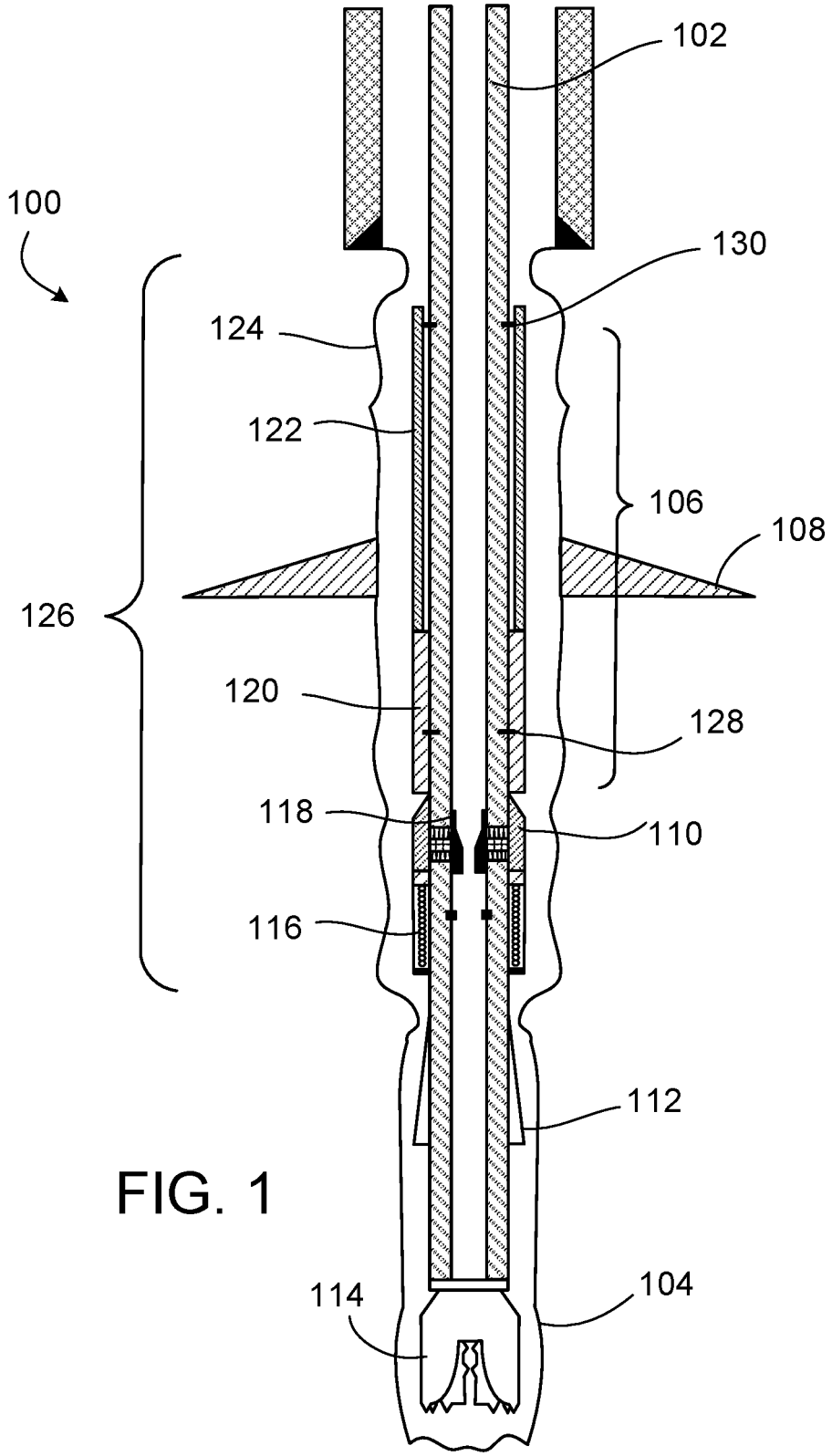
FIG. 1 is a schematic of an example implementation of a bottom hole assembly for loss circulation mitigation in a wellbore.

FIG. 1 shows an example implementation of a bottom hole assembly 100 within wellbore 104. As described later, the bottom hole assembly 100 can be implemented to mitigate loss circulation within the wellbore 104. The bottom hole assembly 100 includes a drill bit 114 on the downstring end of a drill string 102. Upstring of the drill bit 114 and attached to the drill string 102 is an under reamer 112. Under normal drilling conditions, the under reamer 112 is in a retracted state, that is, the cutter arms are not activated, and does not come into contact with the wellbore 104. Upstring of the under reamer 112 is an expansion assembly 126. Expansion assembly 126 surrounds drill string 102 and includes a power spring 116, a movable mandrel 110, a sliding sleeve 118 (with a ball seat), and a radially expandable clad 106. The power spring 116 is configured to move the mandrel 110 towards the expandable clad 106 and is kept in compression or until the expansion assembly 126 is activated. The radially expandable clad 106 includes a hanger 120 (with slotted anchor elements that are easily expanded and provide firm grip onto the rock formation once the hanger is in contact with wall of the wellbore 104) and an expandable base pipe 122. The radially expandable clad 106 is held in place by a first set of lock pins 128 and can also be held in place by a second set of lock pins 130.

The drill bit 114 is rotated by the drill string 102 to form the wellbore 104 and. In some implementations, a mud motor can also be used to increase rate of penetration. Drill bit 114 can be a tri-cone bit, a polycrystalline diamond compact (PDC) bit, or any other drill bit.

The under reamer 112 is used to increase a diameter of a portion of the wellbore 104. The under reamer 112 is configured to be in a retracted state during normal drilling operations. When a high-loss circulation zone 108 is encountered, the under reamer 112 changes to an extended state in response to actuation. While in the extended state, the under reamer 112 is rotated and moved in an uphole direction to engage the wellbore 104 and increase the diameter of the wellbore 104 creating an expanded wellbore portion 124. Under reaming allows the radially expandable clad 106 to be installed in expanded wellbore portion 124 without causing a flow restriction in wellbore 104. Under reaming also allows the drill bit 114 to be pulled from the wellbore without interfering with the radially expandable clad 106. Once a sufficient length of expanded wellbore portion 124 has been created, that is, a length sufficient for the expandable clad 106 to be installed or a length that encompasses the entire circulation zone (whichever is longer), the under reamer 112 returns to its retracted state. The under reamer 112 can be activated by a dropped ball, a dissolving ball, a radio frequency identification (RFID) tag, hydraulically with changing flows or pressures, electronic signals, hydraulic signals, a built-in timer, or any other technique. After the expanded wellbore portion 124 has been created, the expansion assembly 126 is positioned in-line with the high-loss circulation zone 108 and activated. Details on the operation of the expansion assembly 126 are further discussed in greater detail later within this disclosure.

Figure 2:
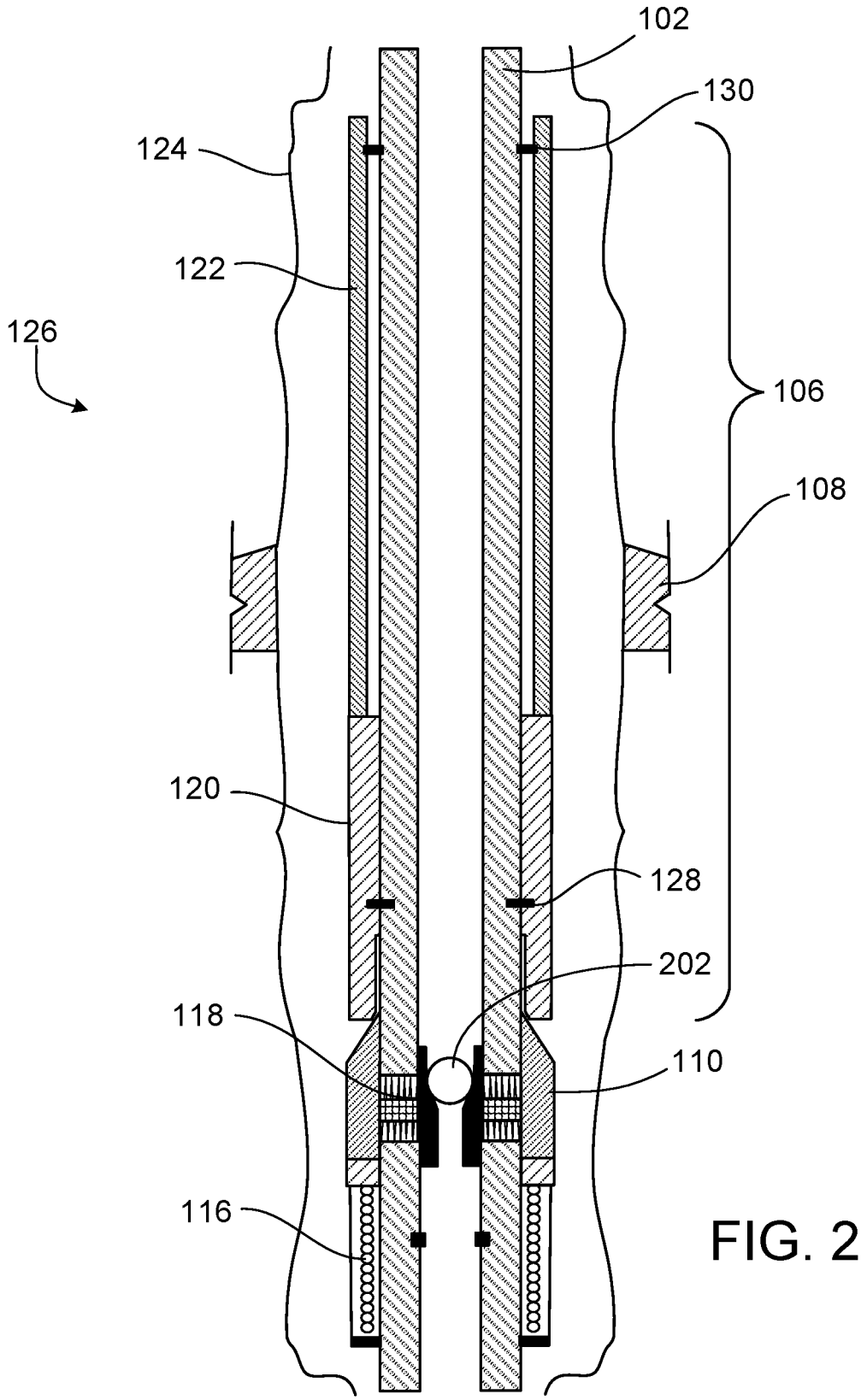
FIG. 2 is a detailed schematic view of an example expansion assembly in the unexpanded state.

FIG. 2 shows a detailed view of the example expansion assembly 126 shown in FIG. 1 in an unexpanded state just before expansion is initiated. The expansion assembly 126 is designed to radially expand the expandable clad 106 in response to actuation. In some implementations, the expansion assembly 126 can be triggered via a ball 202. To expand the expansion assembly 126, a ball 202 is dropped in the center of the drill pipe with drilling fluid. The ball 202 is caught by sliding sleeve 118 with its ball seat, and the ball 202 and the sleeve 118 form a seal. The pressure upstring of the ball 202 and sleeve 118 is greater than the pressure downstring of the ball 202 and sleeve 118; this pressure differential causes the sliding sleeve 118 to move in a downstring direction. The movement of the sleeve 118 initiates the expansion of expansion assembly 126, for example, by releasing the stored force of the power spring 116 to move the mandrel 110 in an upstring direction, and removing or shearing the first set of lock pins 128. The downward movement of the sliding sleeve 118 releases an inner retaining lock-pins of the mandrel 110, that immediately triggers the release of the stored force of the compressed power spring 116. Consequently, the power string 116 pushes the mandrel 110 in an upstring direction to break the first set of shear pins 128 and expand the hanger 120. In some implementations, the second set of lock pins 130 can also be included. The first set of shear pins 118 and the second set of shear pins 130 can secure the expandable clad onto the drill string 102.

As stated previously, the radially expandable clad 106 includes a hanger 120 (with slotted anchor elements that are easily expanded and provide firm grip onto the rock formation once the hanger is in contact with wall of the wellbore 104) and an expandable base pipe 122. In addition to the expandable base pipe 122, the radially expandable clad can also include expandable screens (not shown). The addition of the screens be used in the case of future potential production from the loss circulation zone or fractured reservoir interval. In this case, the expanded clad is intended for flow back through the screens (after cleaning out such as water or acid jetting), but designed to be temporarily plugged somewhat, that is, curing losses, due to solids or drill cuttings while continued drilling operation.

Figure 3:
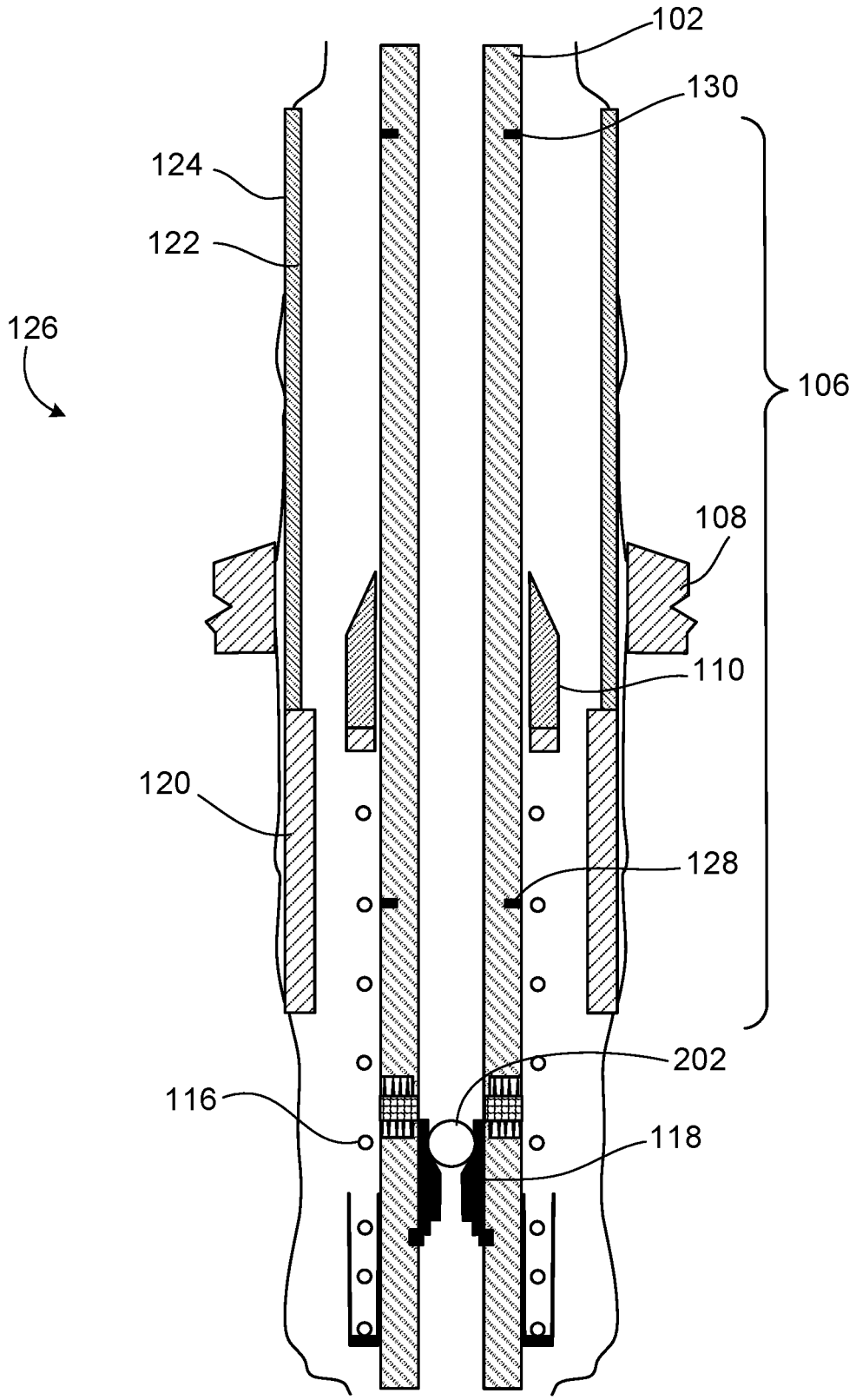
FIG. 3 is a detailed schematic view of an example expansion assembly in the expanded state.

As shown in FIG. 3, the mandrel 110 is released by the actuation of sleeve 118 caused by the dropped ball 202 and allows the power spring 116 to direct the mandrel 110 towards the radially expandable clad 106. In some implementations, the power spring 116 can be kept in compression until the expansion assembly 126 is activated. Once the expansion assembly 126 is activated, the mandrel 110 is directed towards the radially expandable clad 106 as the power spring 116 expands. The mandrel 110 expands the clad towards the walls of the expanded wellbore portion 124. The hanger 120 anchors the radially expandable clad 106 to the walls of the expanded wellbore portion 124. For a relatively short clad system, such as the system shown in FIG. 1, after the hanger 120 is expanded and anchored radially against the rock formation, the whole drilling assembly can be picked up and pulled mechanically uphole to expand the remained clad by a full-gauge string stabilizer (not shown) acting as an expansion cone. Afterwards the whole clad is released from the drilling assembly. The expandable base pipe 122 provides a mechanical wall isolation between the wellbore 104 and high-loss circulation zone 108. As an alternative to being activated by a standard dropped ball 202, the expansion assembly 126 can be activated with a dissolving ball, a radio frequency identification (RFID) tag, hydraulically with changing flows or pressures, electronic signals, hydraulic signals, or other techniques.

Once the radially expandable clad 106 is installed and secured in the expanded wellbore portion 124, the high-loss circulation zone 108 is covered by the radially expandable clad 106 and drilling of the wellbore 104 can continue. In some instances, the installed radially expandable clad 106 is enough to stop circulation fluid loss to high-loss circulation zone 108. In some instances, bridging material can be pumped down the wellbore 104 to assist in mitigating circulation fluid loss to high-loss circulation zone 108. The bridging material can either be circulated down the and through the bottom hole assembly 100, or the bridging material can be reverse circulated, that is, the material is pumped down the annulus between the bottom hole assembly 100 and the wellbore 104. Bridging material can include marble chips, walnut, graphite, fibers, or other similar particulates. The bridging material supplements the sealing ability of the radially expandable clad 106 by plugging any porous spaces remaining in the walls of the expanded wellbore portion 124. In some instances, the particulates within the drilling fluid itself can provide similar sealing assistance. In some instances, the radially expandable clad 106 can seal the high-loss circulation zone 108 well enough to act as a casing section. In some instances, casing can be installed over the radially expandable clad 106 once the wellbore 104 has been drilled completely.

Figure 4:
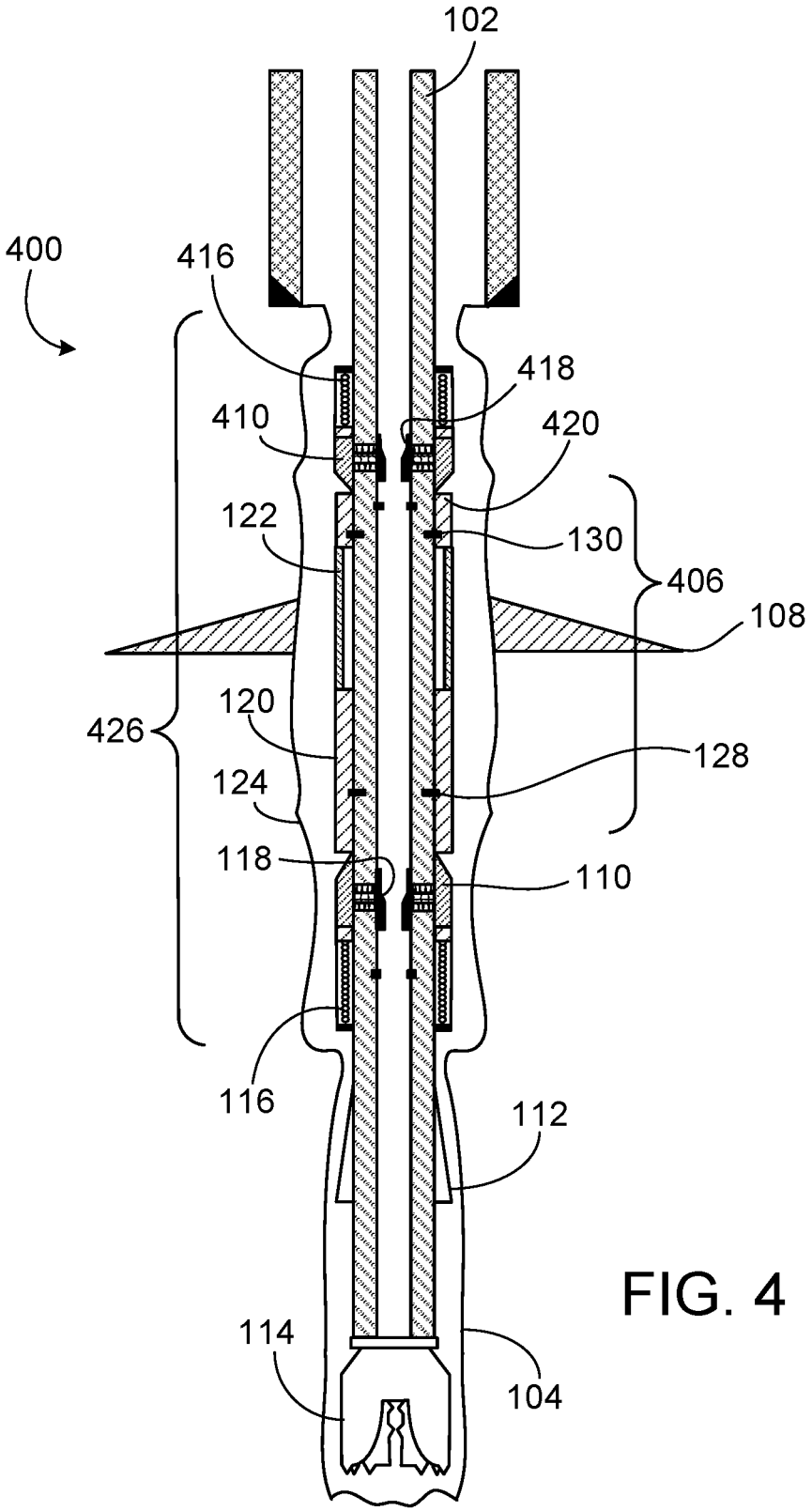
FIG. 4 is a schematic of the bottom hole assembly for loss circulation mitigation of FIG. 1 including an example expansion assembly upstring of a radially expandable clad.

FIG. 4 shows a schematic of the bottom hole assembly for loss circulation mitigation of FIG. 1 including an example expansion assembly upstring of the radially expandable clad 106. The bottom hole assembly 400 includes the drill bit 114 on the downstring end of a drill string 102. Upstring of the drill bit 114 and attached to the drill string 102 is the under reamer 112. Under normal drilling conditions, the under reamer 112 is retracted and does not come into contact with the wellbore 104. Upstring of the under reamer 112 is an expansion assembly 426. Expansion assembly 426 surrounds drill string 102 and includes the first power spring 116, the first mandrel 110, a second power spring 416, a second mandrel 410, the sliding sleeve 118, the first set of lock pins 128, the second set of lock pins 130, and a radially expandable clad 406. The radially expandable clad 406 includes the first hanger 120, a second hanger 420, and the expandable base pipe 122. The first hanger 120 is located at the downstring end of the expandable base pipe 122 while the second hanger 420 is located on the upstring end of the expandable base pipe 122. In this example, two hangers with anchors at both ends of the clad, so the clad can be better anchored against rock formation post installation.

Similar to the first disclosed implementation of bottom hole assembly 100, the under reamer 112 of alternative bottom hole assembly 400 can be actuated via a standard dropped ball, a dissolving ball, an RFID tag, hydraulically with changing flows or pressures, electronic signals, hydraulic signals, or any other means known in the art. Similarly to the first disclosed implementation of bottom hole assembly 100, the expansion assembly 426 of alternative bottom hole assembly 400 can be actuated via a standard dropped ball, a dissolving ball, an RFID tag, hydraulically with changing flows or pressures, electronic signals, hydraulic signals, or any other means known in the art. In this example, both a first sliding sleeve 118 and a second sliding sleeve 418 are used; both the first sliding sleeve 118 and a second sliding sleeve 418 have their own individual ball seats.

In addition to the implementation of bottom hole assembly 400 shown in FIG. 4, the bottom hole assembly can include multiple expansion assemblies that can be used to seal multiple high-loss circulation zones 108. Multiple radially expandable clads 106 can also be utilized if a longer high-loss circulation zone 108 is encountered or if multiple high-loss circulation zones are encountered at different portions of the wellbore 104.

Figure 5:
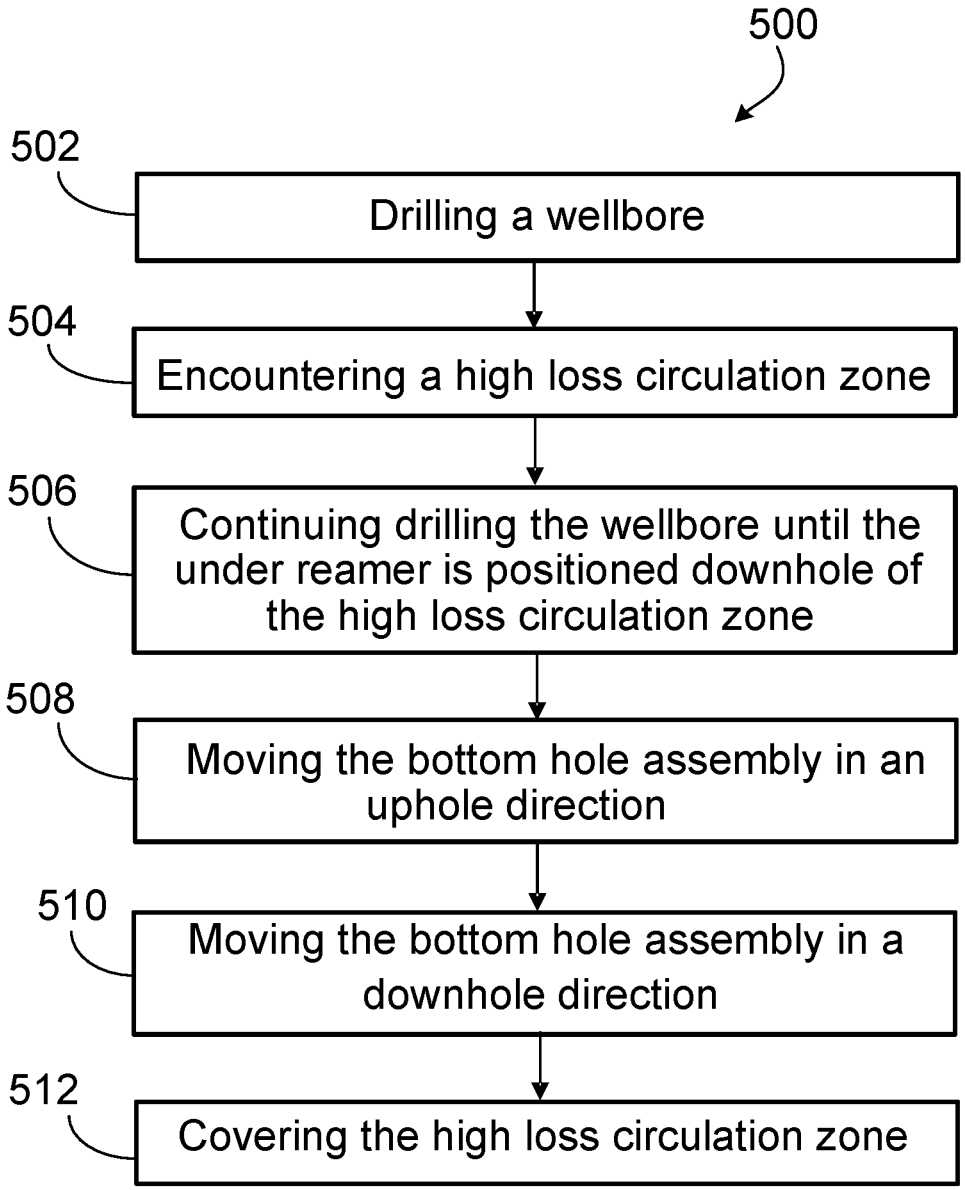
FIG. 5 is a flowchart showing an example method of utilizing the bottom hole assembly.

FIG. 5 shows a flowchart with an example method 500 for utilizing the example bottom hole assembly 100. At 502, a wellbore 104 is drilled in a formation using a bottom hole assembly, such as the example bottom hole assembly 100. At 504, after drilling to a depth, a high-loss circulation zone 108 is encountered while drilling the wellbore 104 in the formation. At 506, the wellbore 104 continues to be drilled until the under reamer 112 is positioned downhole of the high-loss circulation zone. Once the under reamer 112 is downhole of the high-loss circulation zone, the under reamer 112 is actuated from a retracted state to an extended state in which the under reamer 112 engages the wellbore 104 downhole of the high-loss circulation zone. At 508, the bottom hole assembly, such as bottom hole assembly 100, is moved in an uphole direction by a first distance to expand a diameter of the high-loss circulation zone 108 using the under reamer while keeping the bottom hole assembly within the wellbore 104. Once the expanded wellbore section 124 is complete, the under reamer 112 is returned to its retracted state. At 510, the bottom hole assembly is moved in a downhole direction by a second distance to position the expansion assembly adjacent to the high-loss circulation zone. At 512, the high-loss circulation zone is covered by the radially expandable clad 106. After the high-loss circulation zone has been covered, drilling operations continue.

Thus, particular implementations of the subject matter have been described. Other implementations are within the scope of the following claims.

The invention claimed is:

1. A method comprising:

drilling a wellbore in a formation using a bottom hole assembly comprising:

a drill bit attached to a drill string, an under reamer attached to the drill string upstring of the drill bit, and an expansion assembly surrounding the drill string upstring of the under reamer, the expansion assembly comprising a radially expandable clad, a mandrel surrounding the drill string downstring of the clad, a sliding sleeve surrounded by the drill string, and a power spring attached to the mandrel;

while drilling the wellbore in the formation, encountering a high-loss circulation zone into which drilling fluid is lost during the drilling, wherein the under reamer is positioned downhole of the high-loss circulation zone;

moving the bottom hole assembly in an uphole direction to expand a diameter of the high-loss circulation zone using the under reamer while retaining the bottom hole assembly within the wellbore;

after expanding the diameter of the high-loss circulation zone, moving the bottom hole assembly in a downhole direction to position the expansion assembly adjacent the high-loss circulation zone; and after positioning the expansion assembly adjacent the high-loss circulation zone, covering the high-loss circulation zone using the expansion assembly, wherein covering the high-loss circulation zone using the expansion assembly comprises sliding the sliding sleeve along the drill string, directing the mandrel toward the clad with the power spring, and radially expanding the radially expandable clad.

2. The method of claim 1, further comprising continuing drilling the wellbore in the formation after covering the high-loss circulation zone using the expansion assembly.

3. The method of claim 2, wherein expanding the diameter of the high-loss circulation zone using the under reamer comprises engaging the under reamer to expand the diameter of the high-loss circulation zone, wherein the method further comprises, prior to continuing drilling in the wellbore, disengaging the under reamer.

4. The method of claim 1, wherein the high-loss circulation zone is covered using the expansion assembly without removing the bottom hole assembly from within the wellbore.

5. The method of claim 1, wherein moving the bottom hole assembly in the uphole direction to expand the diameter of the high-loss circulation zone using the under reamer comprises expanding a first diameter of a first portion of the wellbore above the high-loss circulation zone and a second diameter of a second portion of the wellbore below the high-loss circulation zone.

6. The method of claim 1, wherein an uphole end of the high-loss circulation zone is below a surface of the formation, wherein the bottom hole assembly is moved in the uphole direction to at least the uphole end of the high-loss circulation zone and below the surface of the formation.

7. A method comprising:

drilling a wellbore in a formation using a bottom hole assembly comprising:

a drill bit attached to a drill string, an under reamer attached to the drill string upstring of the drill bit, and an expansion assembly surrounding the drill string upstring of the under reamer, the expansion assembly comprising a radially expandable clad, a mandrel surrounding the drill string downstring of the clad, a sliding sleeve surrounded by the drill string, and a power spring attached to the mandrel;

after drilling the wellbore to a depth in the formation, encountering a high-loss circulation zone into which drilling fluid is lost during the drilling;

continuing drilling the wellbore until the under reamer is positioned downhole of the high-loss circulation zone;

moving the bottom hole assembly by a first distance in an uphole direction to expand a diameter of the high-loss circulation zone using the under reamer, wherein the distance by which the bottom hole assembly is moved in the uphole direction is less than the depth to which the wellbore is drilled;

after expanding the diameter of the high-loss circulation zone, moving the bottom hole assembly in a downhole direction by a second distance to position the expansion assembly adjacent the high-loss circulation zone; and after positioning the expansion assembly adjacent the high-loss circulation zone, covering the high-loss circulation zone using the expansion assembly, wherein covering the high-loss circulation zone using the expansion assembly comprises sliding the sliding sleeve along the drill string, directing the mandrel toward the clad with the power spring, and radially expanding the radially expandable clad.

8. The method of claim 7, further comprising continuing drilling the wellbore in the formation after covering the high-loss circulation zone using the expansion assembly.

9. The method of claim 7, wherein the radially expandable clad is configured to expand from a first diameter to a second diameter greater than the first diameter, wherein the second diameter is equal to the diameter of the high-loss circulation zone widened by the under reamer, wherein the clad surrounds the drill string, wherein the clad further comprises:

an expandable base pipe surrounding the drill string; and a hanger surrounding the drill string, the hanger connected to the expandable base pipe, the hanger configured to anchor the clad to the high-loss circulation zone when the clad is radially expanded to the second diameter, wherein moving the bottom hole assembly in the downhole direction by the second distance to position the expansion assembly adjacent the high-loss circulation zone comprises positioning an upstring end of the expandable base pipe adjacent to an uphole end of the high-loss circulation zone.

10. The method of claim 7, wherein the radially expandable clad is configured to expand from a first diameter to a second diameter greater than the first diameter, wherein the second diameter is exactly equal to the diameter of the high-loss circulation zone widened by the under reamer, wherein the clad surrounds the drill string, wherein the clad further comprises:

an expandable base pipe surrounding the drill string; and a hanger surrounding the drill string, the hanger connected to the expandable base pipe, the hanger configured to anchor the clad to the high-loss circulation zone when the clad is radially expanded to the second diameter, wherein moving the bottom hole assembly in the downhole direction by the second distance to position the expansion assembly adjacent the high-loss circulation zone comprises positioning an upstring end of the expandable base pipe directly adjacent to an uphole end of the high-loss circulation zone.

* * * * *